US005294510A

United States Patent [19]

Ueda et al.

[11] Patent Number: 5,294,510

[45] Date of Patent: Mar. 15, 1994

[54] PHOTOSENSITIVE MEMBER CONTAINING SPECIFIC COUMARIN FLUORESCENT BLEACHING AGENT

[75] Inventors: Hideaki Ueda, Kawanishi; Shigeaki Tokutake, Takatsuki; Kimiyuki Ito, Kawanishi; Yuki Shimada, Suita, all of Japan

[73] Assignee: Minolta Camera Kabushiki Kaisha, Osaka, Japan

[21] Appl. No.: 714,716

[22] Filed: Jun. 13, 1991

[30] Foreign Application Priority Data

Jun. 14, 1990 [JP] Japan ..... 2-155853
Jun. 14, 1990 [JP] Japan ..... 2-155854
Jun. 14, 1990 [JP] Japan ..... 2-155855
Jun. 14, 1990 [JP] Japan ..... 2-155857

[51] Int. Cl.[5] ..... G03G 5/09

[52] U.S. Cl. ..... 430/58; 430/78; 430/83; 430/59

[58] Field of Search ..... 430/59, 58, 75, 83, 430/78, 77

[56] References Cited

U.S. PATENT DOCUMENTS 3,180,729 4/1965 Klupfel et al. ..... 96/1
3,189,447 6/1965 Neugebauer et al. ..... 96/1
3,647,467 3/1972 Grubb ..... 96/90
3,725,074 4/1973 Shiba et al. ..... 96/122
4,174,216 11/1979 Cohen et al. ..... 430/257
4,232,112 11/1980 Kuse ..... 430/393
4,302,521 11/1981 Takei et al. ..... 430/59
4,550,073 10/1985 Neiss et al. ..... 430/273
4,603,104 7/1986 Philip, Jr. ..... 430/572
4,839,269 6/1989 Okazaki et al. ..... 430/570
5,116,702 5/1992 Okano et al. ..... 430/54

FOREIGN PATENT DOCUMENTS 57-88455 6/1982 Japan .
59-123845 7/1984 Japan .
63-159860 7/1988 Japan .
2-61643 3/1990 Japan .

*Primary Examiner*—Marion E. McCamish
*Assistant Examiner*—Rosemary Ashton
*Attorney, Agent, or Firm*—Burns, Doane, Swecker & Mathis

[57] ABSTRACT

A photosensitive member is disclosed, which comprises a photosensitive layer containing a fluorescent bleaching agent comprising a coumarin compound represented by the formula (I):

(I)

5 Claims, 1 Drawing Sheet

PHOTOSENSITIVE MEMBER CONTAINING SPECIFIC COUMARIN FLUORESCENT BLEACHING AGENT

BACKGROUND OF THE INVENTION

This invention relates to a photosensitive member containing a specific fluorescent bleaching agent.

In electrophotography, copied images are formed by various kinds of methods. For example, the surface of a photosensitive member is charged and irradiated to form electrostatic latent images thereon, the electrostatic latent images are developed by a developer to be made visible and then the developed electrostatic latent images are fixed directly onto the photosensitive member (referred to as a direct method). In other method, developed electrostatic latent images on a photosensitive member which are made visible by a developer are transferred to a copying paper and then, the transferred images are fixed on the paper (referred to as a powder transferring method). In another method, electrostatic latent images on a photosensitive member are transferred onto a copying paper, the transferred electrostatic latent images are developed by a developer and then fixed on the copying paper (referred to as an electrostatic latent image transferring method).

Known photosensitive materials for forming such a photosensitive member include inorganic photoconductive materials such as selenium, cadmium sulfide or zinc oxide.

These photosensitive materials have many advantages such as low loss of charges in the dark, an electrical charge which can be rapidly dissipated with irradiation of light and the like. However, they have disadvantages. For example, a photosensitive member based on selenium is difficult to produce, has high production costs and is difficult to handle due to inadequate resistivity to heat or mechanical impact. A photosensitive member based on cadmium sulfide or zinc oxide has defects such as its unstable sensitivity in a highly humid environment and loss of stability with time because of the deterioration of dyestuffs, added as a sensitizer, by corona charge and fading with exposure.

Many kinds of organic photoconductive materials such as polyvinylcarbazole and so on have been proposed. These organic photoconductive materials have superior film forming properties, are light in weight, etc., but inferior in sensitivity, durability and environmental stability compared to the aforementioned inorganic photoconductive materials.

Physical properties or electrophotographic properties of a coating layer as a photosensitive member may be adjusted desirably by using an organic photoconductive material of low molecular weight in the combination with a selected binder resin, a selected composition or the like. However, the high compatibility of an organic photoconductive material with a binder resin is required because the photoconductive material is used together with the binder resin.

A photosensitive member prepared by dispersing an organic photoconductive compound of low molecular weight or high molecular weight in a binder resin has problems such as high residual potential caused by many traps of carriers, low sensitivity and the like. Therefore, a charge transporting material is further incorporated in a photosensitive member in order to overcome the problems as above mentioned, and a function-divided photosensitive member of a laminated or a dispersed type has been also proposed, in which charge generating function and charge transporting function are divided by different layers or different dispersed materials.

Many kinds of organic compounds are used as a charge transporting material, which have, however, many problems. For example, 2,5-bis(p-diethylaminophenyl)-1,3,4-oxadiazole disclosed in U.S. Pat. No. 3,189,447 is low in compatibility with a binder and liable to separate out. A diarylalkane derivative disclosed in U.S. Pat. No. 3,820,989 is good in compatibility with a binder resin, but changes in sensitivity when used repeatedly. A hydrazone compound disclosed in JP Laid-open No. 54-59143 is relatively good in residual potential properties, but being poor in chargeability and repetition properties.

Repetition properties, light-fatigue properties, or durability properties thereof are required as well as sensitivity and chargeability in order to meet utility of a photosensitive member.

However, an organic photosensitive member has, in general, problems such as unstability in initial surface potential or light decaying properties, remarkable light fatigue and poor durability.

There are proposed, for example, Japanese Patent Laid-open 60-191264 or 59-123845 to improve photosensitivity and durability of a photosensitive member.

Japanese Patent Laid-open 60-191264 discloses that a hydrazone compound is contained in a photosensitive member to achieve excellent photosensitivity and repetition properties of initial surface potential. It is further disclosed that the addition of an acridine dye, a thiazine dye or an oxazine dye is effective to improve photosensitivity. However, the photosensitive member disclosed therein is also unstable in electrophotographic properties such as surface potential, residual potential and the like when used repeatedly.

Japanese Patent Laid-open 59-123845 discloses a photosensitive member having a charge generating layer and a charge transporting layer in which an electron donating compounds such as phenazine, triazole and the like are incorporated into the charge generating layer to improve the injection effectiveness of charges generated in the charge generating layer into the charge transporting layer for improvement of photosensitivity. The objects of this technique, however, are not to improve repetition properties, durability and the like of a photosensitive member, being different from those of the present invention.

On the other hand, Japanese Patent Laid-open 62-249167 discloses that a thioxanthone compound is added into a photosensitive layer to stabilize repetition properties. Japanese Patent Laid-open 62-262053 discloses that a thiuram monosulfide compound is added into a photosensitive layer to stabilize repetition properties. Japanese Patent Laid-open 62-30256 discloses that a triphenylmethane pigment is added to stabilize repetition properties. However, further improvements of repetition properties, durability and the like are required in these photosensitive members.

SUMMARY OF THE INVENTION

The object of the present invention is to provide a photosensitive member excellent in electrophotographic properties such as sensitivity, surface potential and the like and able to form copied images of high quality stably, even after repeatedly used.

The object of the invention can be achieved by incorporating a specific fluorescent bleaching agent into a photosensitive member.

DETAILED DESCRIPTION OF THE INVENTION

Figure 1:
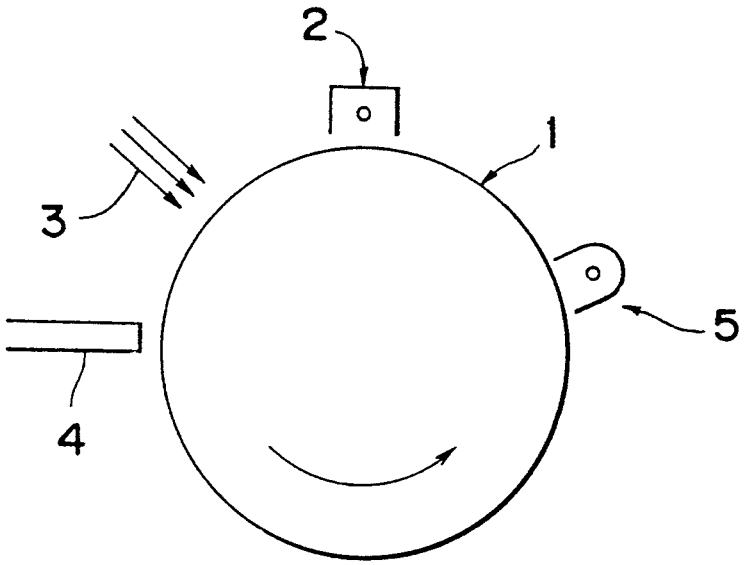
FIG. 1 shows a schematic structural view of a tester for a photosensitive member.

The present invention provides a photosensitive member excellent in electrophotographic properties (sensitivity, surface potential etc.) even after repeatedly used.

The present invention has accomplished the above object by introduction of a specific fluorescent bleaching agent into a photosensitive layer.

The present invention relates to a photosensitive member comprising a fluorescent bleaching agent selected from the group consisting of coumarins, pyrazolines, oxazoles, oxadiazoles, and stilbenes, the coumarins, the pyrazolines and the stilbenes absorbing ultraviolet lights and having fluorescence emission peak at about 420 nm, and the oxazoles and the oxadiazoles having maximum absorption peak of laser light.

The coumarins in the present invention mean derivatives having a coumarin skeleton as a basic chemical structure and are used as a fluorescent bleaching agent. The fluorescent bleaching agent in the present invention includes the one which can emit fluorescence and appears whiter when exposed under sun light.

In particular, preferable coumarins are the ones that absorb ultraviolet lights and emit fluorescence within the range of visible light wavelength, preferably blue fluorescence of about 420 nm.

Such a coumarin compound is exemplified by the one represented by the general formula [I].

[I]

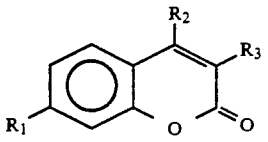

in which $R_1$ is an amino group, an alkyl group-substituted amino group, a hydroxy group,

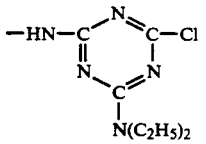

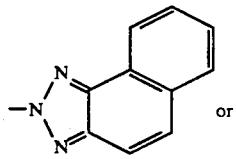

or

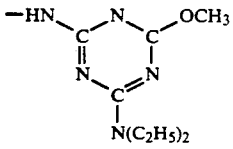

$R_2$ is a hydrogen atom or fluoroalkyl group; $R_3$ is a hydrogen atom, an alkyl group or an aryl group. Other coumarins available in the market as the fluorescent bleaching agent may be used.

Concrete coumarin compounds are exemplified as below;

[I-1]

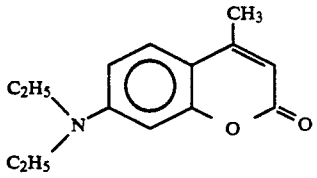

[I-2]

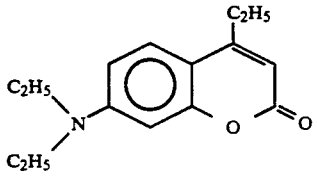

[I-3]

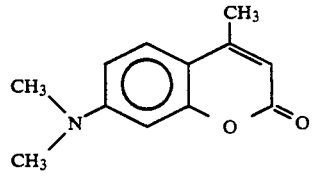

[I-4]

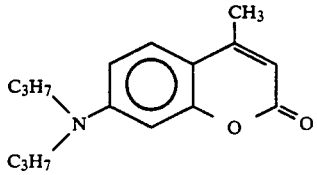

[I-5]

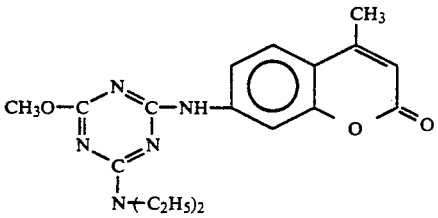

[I-6]

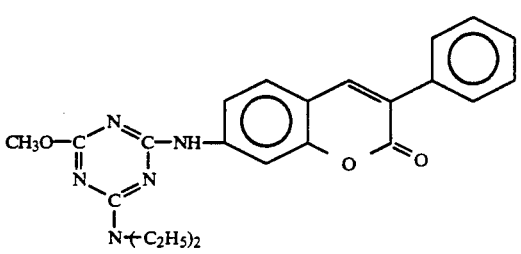

[I-7]

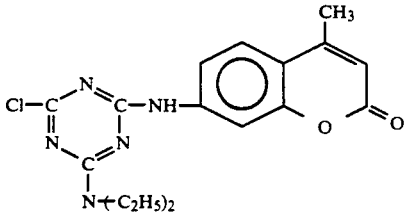

-continued

[I-8]

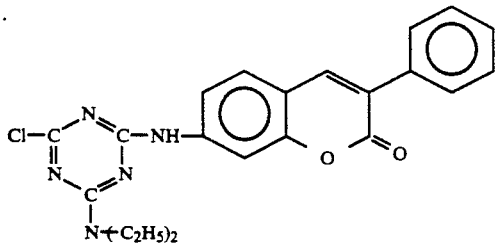

[I-9]

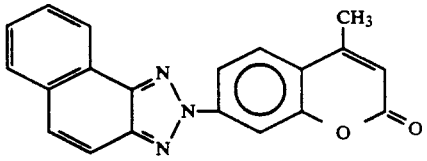

[I-10]

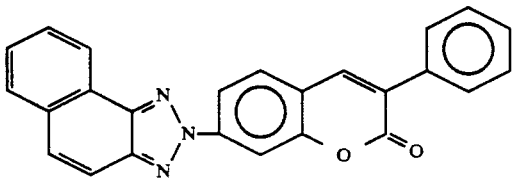

[I-11]

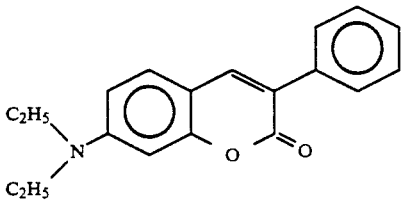

[I-12]

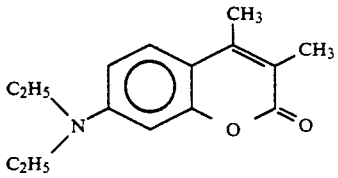

[I-13]

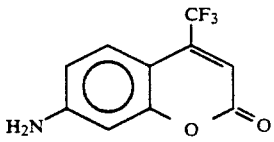

[I-14]

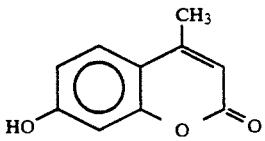

The pyrazolines in the present invention include derivatives having a pyrazoline skeleton as a basic chemical structure and are used as a fluorescent bleaching agent. The fluorescent bleaching agent in the present invention means the one which can emit fluorescence and appears whiter when exposed under sun light.

In particular, preferable pyrazolines are the ones that absorb ultraviolet lights and emit fluorescence within the range of visible light wavelength, preferably blue fluorescence of about 420 nm.

Such a pyrazoline compound is exemplified by the one represented by the general formula [II]

[II]

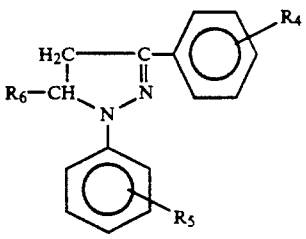

in which $R_4$ is a hydrogen atom, a lower alkyl group such as methyl group and the like, a halogen atom such as chlorine atom and the like; $R_5$ is a hydrogen atom, a lower alkyl group such as a methyl group and the like, a $-SO_3Na$ group, a $-SO_2NH_2$ group or a $-COOCH_3$ group; $R_6$ is a hydrogen atom or an aryl group such as a phenyl group and the like. Other pyrazolines available in the market as the fluorescent bleaching agent may be used.

In particular, preferable pyrazolines are the ones that absorb ultraviolet lights and emit fluorescence within the range of visible light wavelength, preferably blue fluorescence of about 420 nm.

Concrete pyrazoline compounds are exemplified as follows;

[II-1]

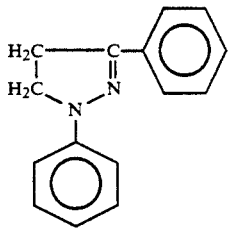

[II-2]

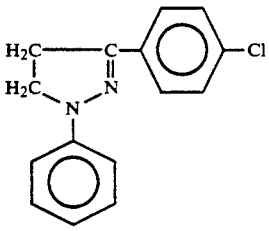

[II-3]

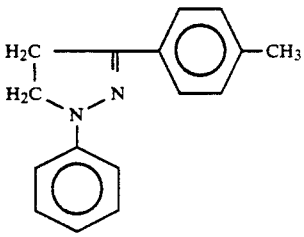

-continued

[II-4]

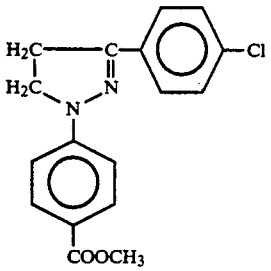

[II-5]

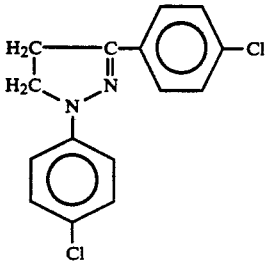

[II-6]

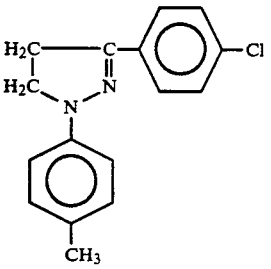

[II-7]

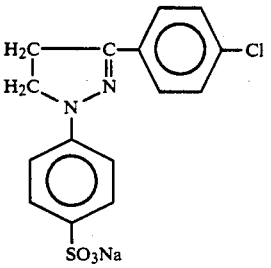

[II-8]

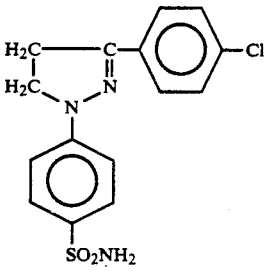

[II-9]

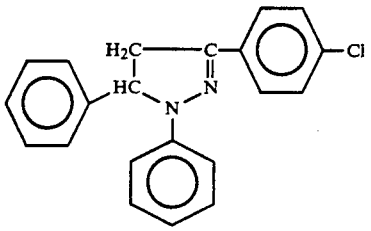

-continued

[II-10]

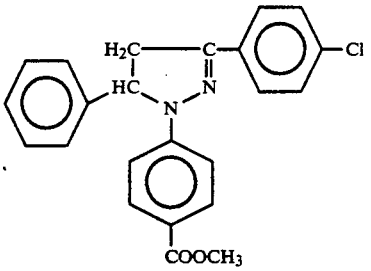

[II-11]

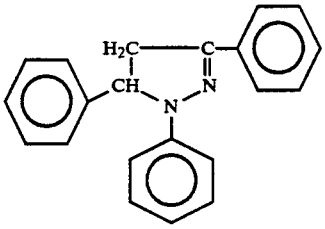

[II-12]

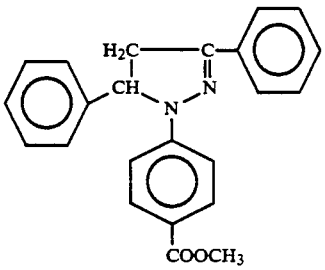

The oxazole pigments or the oxadiazole dyes in the present invention include derivatives having an oxazole skeleton or an oxadiazole skeleton as a basic chemical structure and are used as a laser dye. The laser dye in the present invention means the one having relatively high quantum yield of fluorescence. In particular, the laser dye is required to have small transition possibility from single excited state ($S_1$) to triplet excited state ($S_3$) and to dissolve in an adequate solvent. Preferable laser dyes emit fluorescence strongly when excited by a laser beam. The laser means, for example, gas-state laser, solid-state laser, flash lamp and the like in this specification.

Such an oxadiazole compound for laser dye represented by the general formula [III] my be used;

[III]

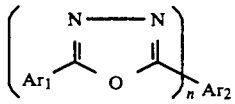

in which $Ar_1$ is a phenyl group, a naphthyl group, a biphenyl group, an alkylphenyl group or a halogenated phenyl group; $Ar_2$ is a phenyl group, a naphthyl group or a biphenyl group; n is an integer 1 or 2.

The oxazole compound for laser dye represented by the general formula [IV] may be used;

[IV]

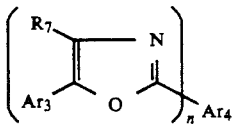

in which $Ar_3$ is a phenyl group, a naphthyl group, a biphenyl group, an alkylphenyl group or a halogenated phenyl group; $Ar_4$ is a phenyl group, a naphthyl group or a biphenyl group; $R_7$ is a hydrogen atom, a methyl group or a halogen atom; n is an integer of 1 or 2. Other oxazole compounds and other oxadiazole compounds available in the market may be used so far as they are used as the laser dye.

Concrete oxazole compounds or oxadiazole compounds are exemplified as follows;

[III-1]

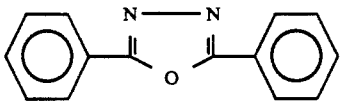

[III-2]

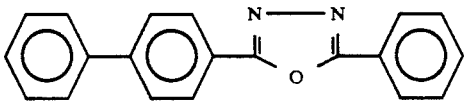

[III-3]

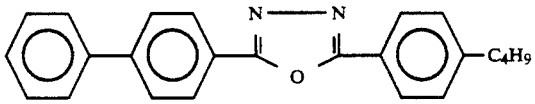

[III-4]

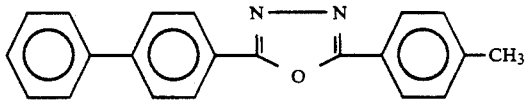

[IV-1]

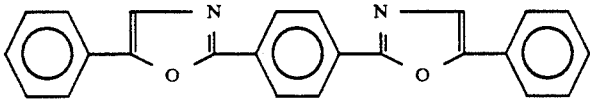

[IV-2]

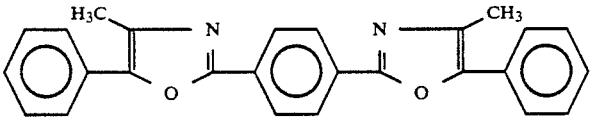

[IV-3]

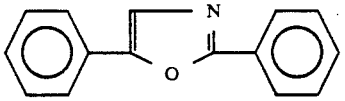

[IV-4]

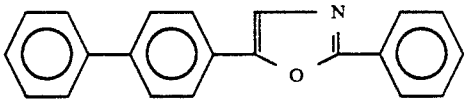

[IV-5]

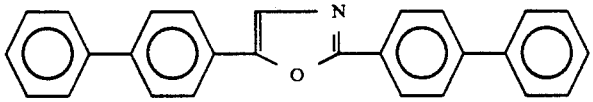

[IV-6]

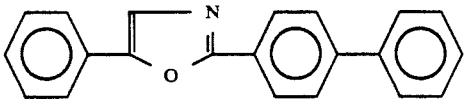

[IV-7]

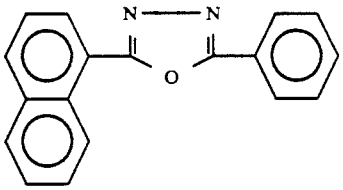

-continued

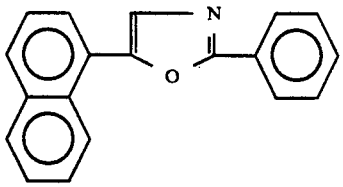
[IV-8]

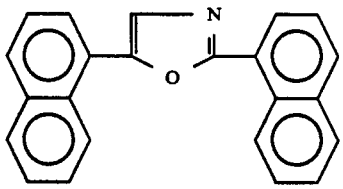
[IV-9]

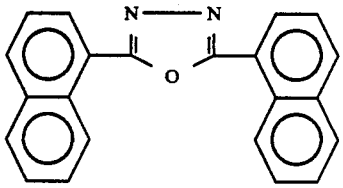
[IV-10]

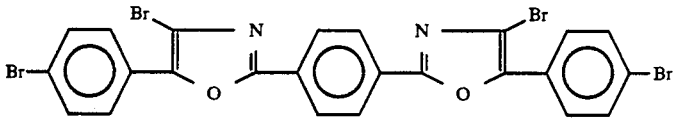
[IV-11]

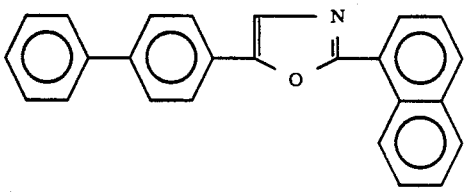
[IV-12]

The stilbenes in the present invention include derivatives having a stilbene skeleton as a basic chemical structure and are used as a fluorescent bleaching agent. The fluorescent bleaching agent in the present invention means the one which can emit fluorescence and appears whiter when exposed under sun light.

In particular, preferable stilbenes are the ones that absorb ultraviolet lights and emit fluorescence within the range of visible light wavelength, preferably blue fluorescence of about 420 nm.

Such a stilbene compound is exemplified by the one represented by the general formula [V];

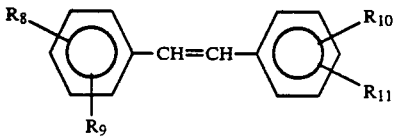
[V]

in which $R_8$, $R_9$, $R_{10}$ and $R_{11}$ are independently an aryl group such as a phenyl group and the like, an alkyl group, a sulfonyl group, an amino group, a triazinylamino group, a benzotriazolyl group, a benzoxazole group, a phenylcarbamoyl group, a phenyl-NHCONH group and the like, each of which may have a substituent; $R_8$, $R_9$, $R_{10}$ and $R_{11}$ may be a hydrogen atom respectively, or the one represented by the general formula [VI];

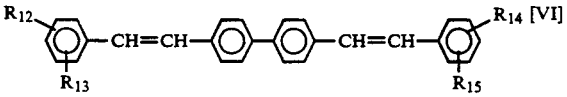
[VI]

in which $R_{12}$, $R_{13}$, $R_{14}$ and $R_{15}$ are independently a hydrogen atom, a halogen atom, a sulfonyl group or a phenyl group. Other stilbene compounds available in the market as the fluorescent bleaching agent may be used.

Concrete stilbene compounds are exemplified as below;

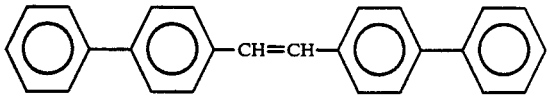
[V-1]

-continued
[V-2]
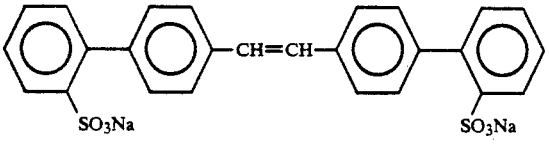
[V-3]
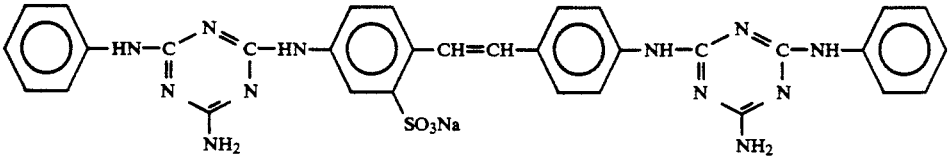
[V-4]
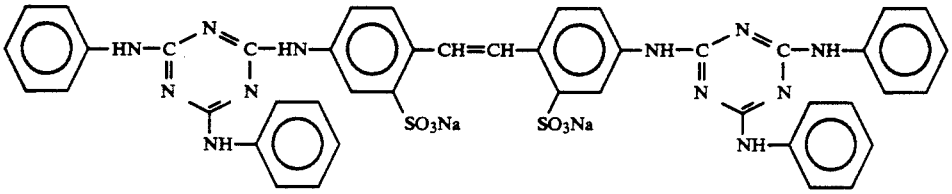
[V-5]
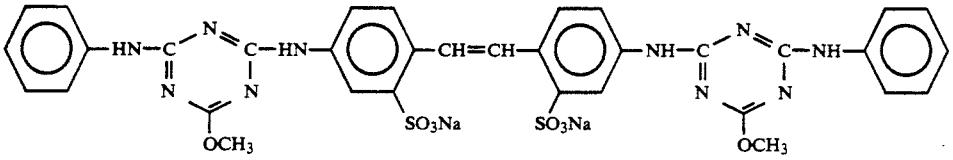
[V-6]
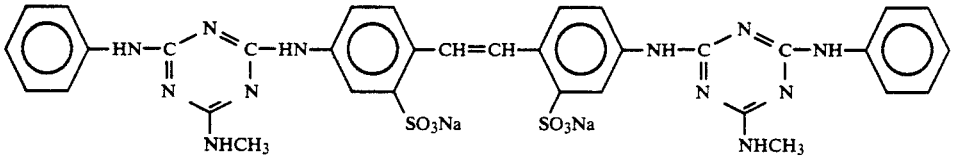
[V-7]
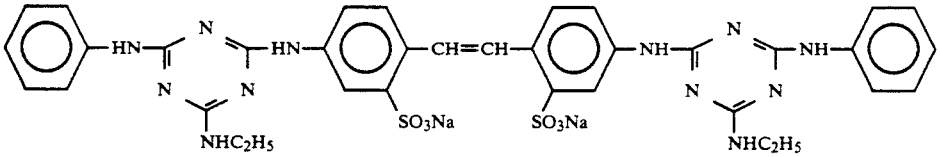
[V-8]
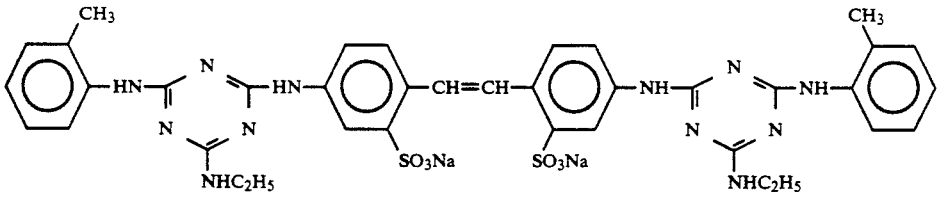
[V-9]
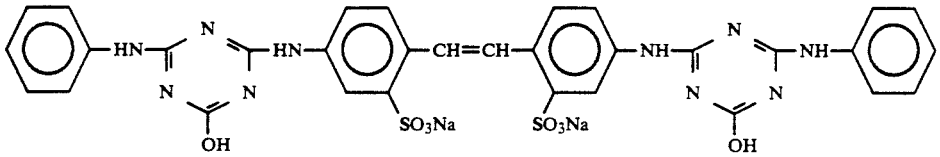
[V-10]
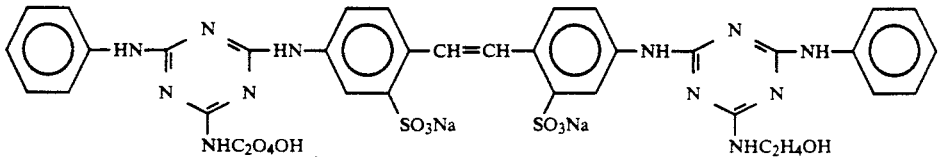

-continued
[V-11]
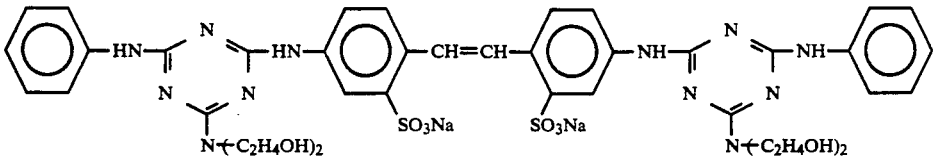
[V-12]
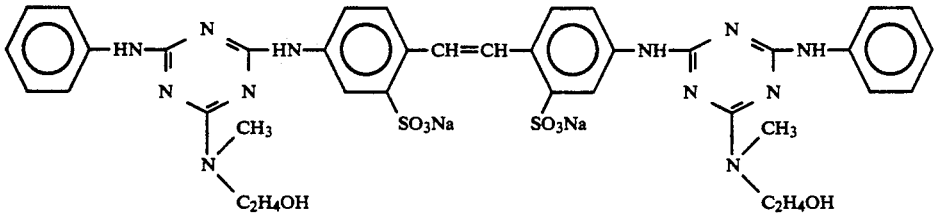
[V-13]
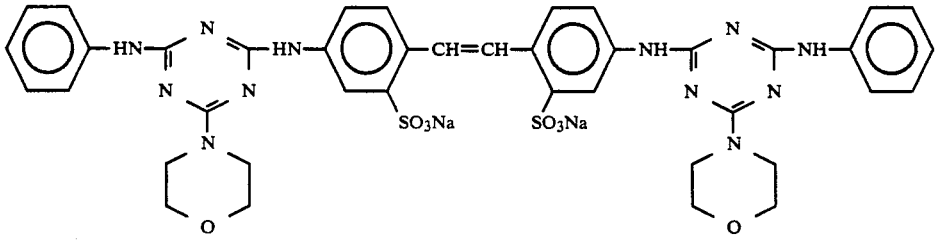
[V-14]
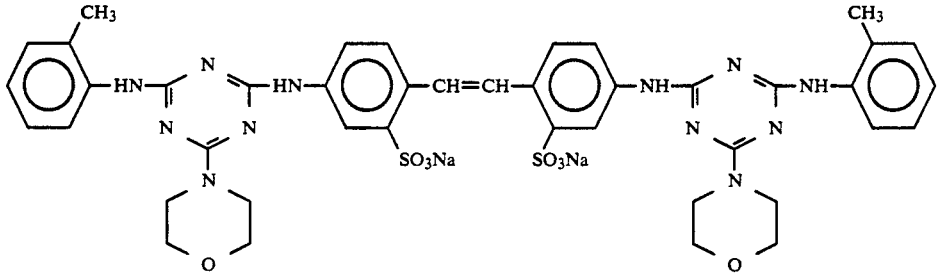
[V-15]
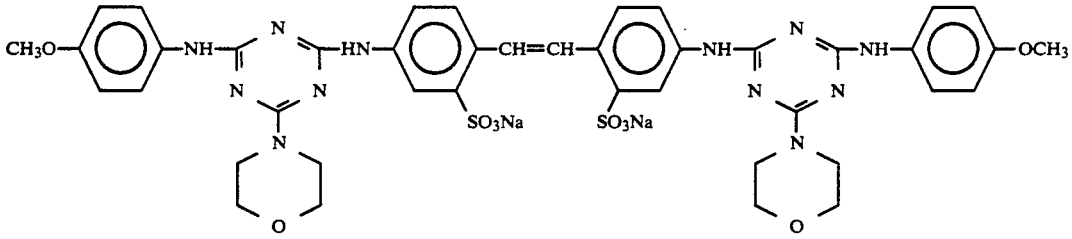
[V-16]
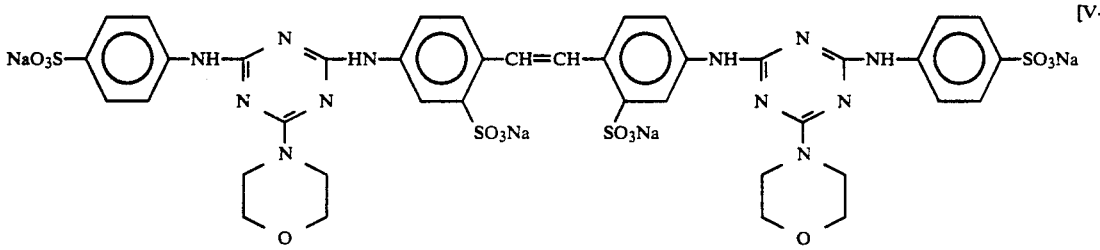

-continued
[V-17]
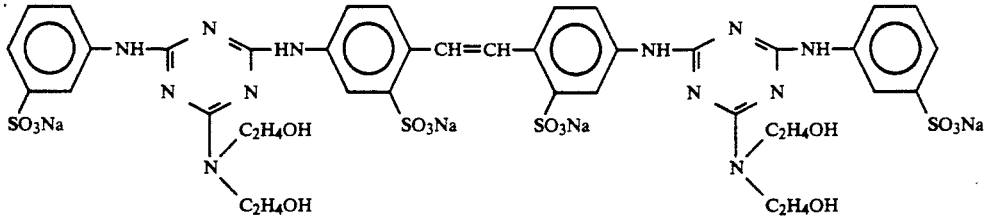
[V-18]
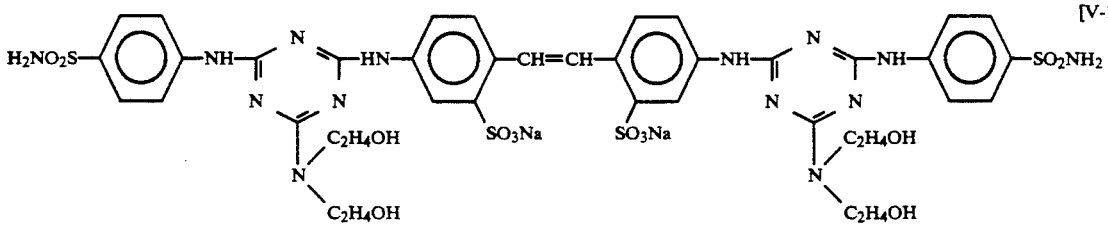
[V-19]
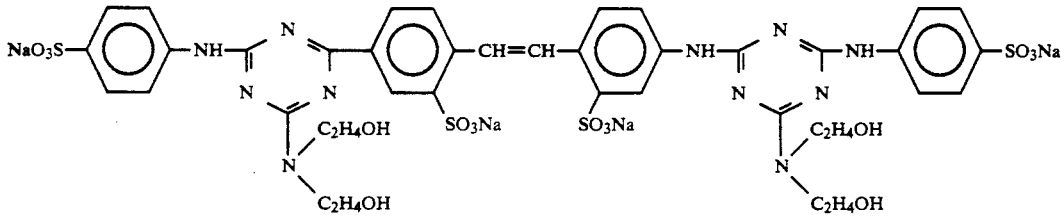
[V-20]
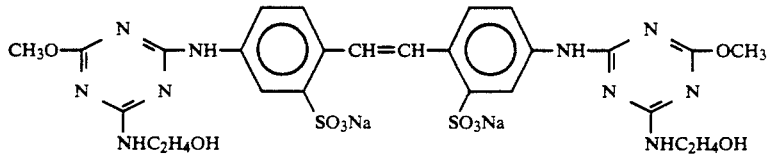
[V-21]
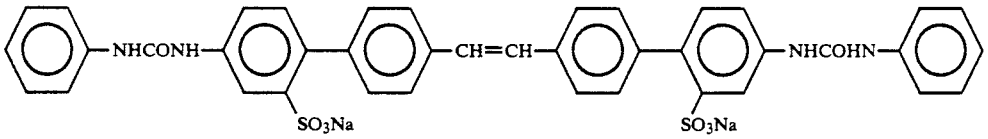
[V-22]
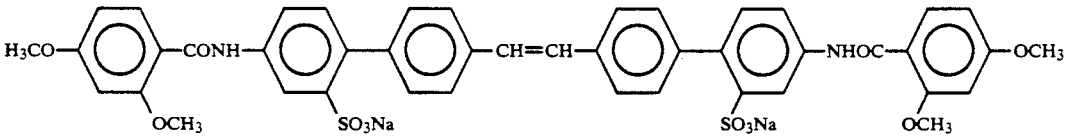
[V-23]
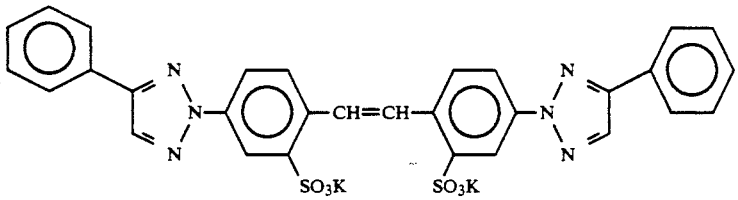
[V-24]
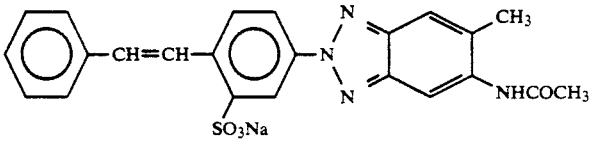

-continued
[V-25]
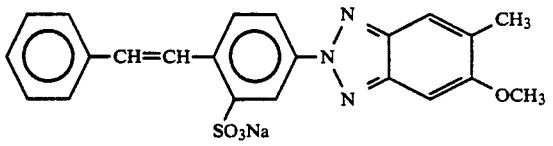
[V-26]
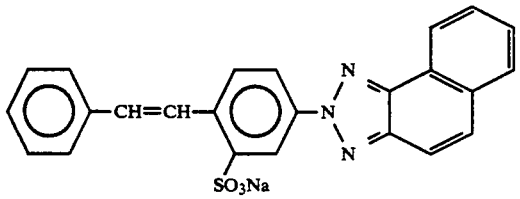
[V-27]
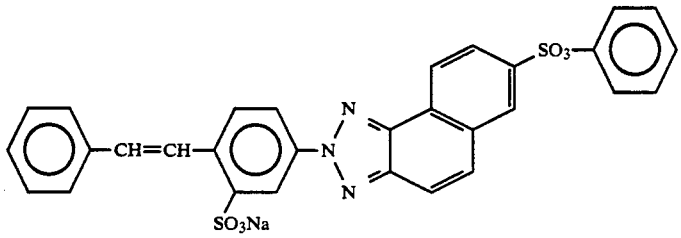
[V-28]
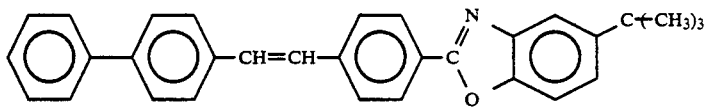
[VI-1]
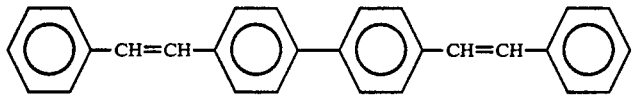
[VI-2]
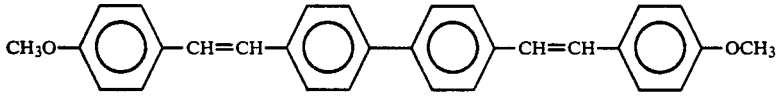
[VI-3]
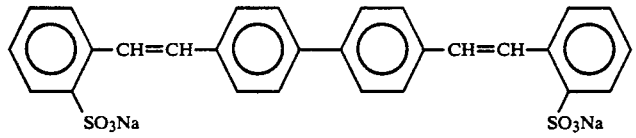
[VI-4]
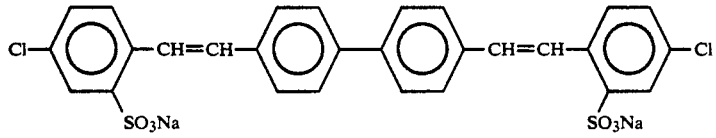
[V-29]
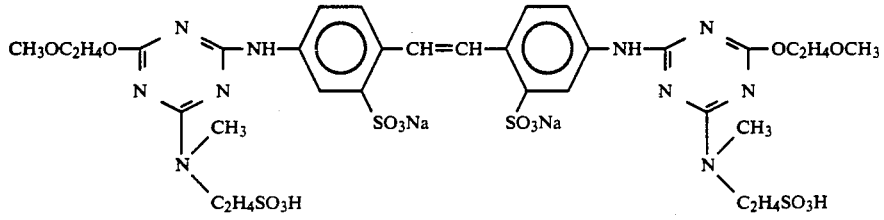

-continued

[V-30]

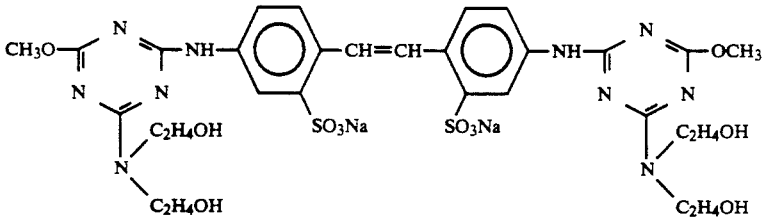

[V-31]

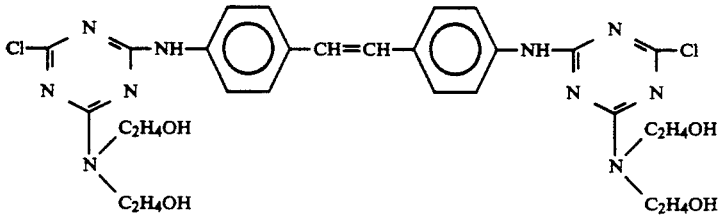

[V-32]

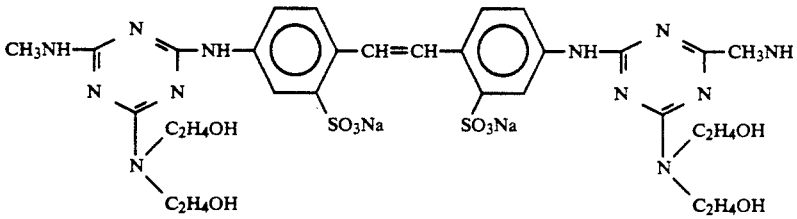

[VI-5]

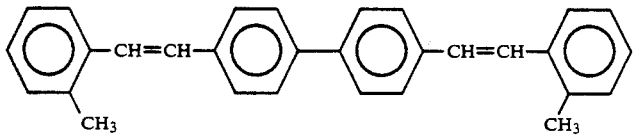

[VI-6]

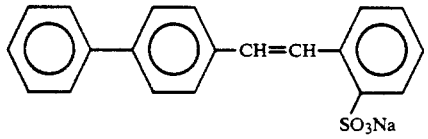

A photosensitive member of the invention has a photosensitive layer comprising one or more fluorescent bleaching agents above mentioned. A photosensitive member, various types of which are known, may be any type in the invention. For example, a photosensitive member of the invention may be a monolayer type in which a photosensitive layer is formed on a substrate by dispersing a charge generating material and a charge transporting material in a resin binder or a laminated type in which first a charge generating layer containing mainly a charge generating layer is formed on a substrate and then a charge transporting layer is formed on the charge generating layer.

In order to form a photosensitive member of a monolayer type, a fluorescent bleaching agent is dispersed in a resin solution together with a charge transporting compound and a charge generating material, which is spray dried on an electrically conductive substrate.

In this case, the charge transporting material is used generally, at the content of 0.01–2 parts by weight on the basis of the binder resin of one part by weight. The addition amount of the fluorescent bleaching agent is 0.1–40 percents by weight, preferably 0.5–30 percents by weight, more preferably 1–20 percents by weight. If the addition amount is more than 40 percents by weight, the sensitivity becomes poor and the residual potential increases. If the addition amount is less than 0.1 percent by weight, the effects of the invention can not be obtained.

The thickness of the photosensitive layer is 3–30 μm, preferably 5–20 μm. The sensitivity is poor if the charge generating layer is used in an insufficient quantity, whereas the chargeability is poor and the mechanical strength of the photosensitive layer is inadequate if used to excess. The amount of the charge generating layer is within the range of 0.01–3 parts by weight, preferably, 0.2–2 parts by weight on the basis of one part by weight of resin.

In order to form a preferable photosensitive member of a function-divided type, a charge generating material is deposited in a vacuum on a substrate, a charge generating material is dissolved in an amine solvent to apply onto a substrate or an application solution containing a charge generating material and, if necessary, binder resin dissolved in an appropriate solvent is applied onto a substrate to be dried. Thus, a charge generating layer is formed. Then, a solution containing a charge transporting material, a fluorescent bleaching agent and a binder is applied onto the charge generating layer.

When the charge generating layer is formed in the form of a resin-dispersion type, the charge generating material is used at the content of 0.1–5 parts by weight on the basis of the binder resin of one part by weight on account of the same reason as described in the formation of monolayer type photosensitive layer.

In this case, the fluorescent bleaching agent may be added into the charge generating layer. The preferable content thereof is 0.01–3 parts by weight, preferably 0.05–0.3 parts by weight on the basis of the charge generating material of one part by weight.

When the charge transporting layer is formed, the charge transporting material is used at the content of 0.2–2 parts by weight, preferably 0.3–1.3 parts by weight on the basis of the binder resin of one part by weight. The addition amount of the fluorescent bleaching agent is 0.1–40 percents by weight, preferably 0.5–30 percents by weight, more preferably 1–20 percents by weight on account of the same reason as described in the formation of monolayer type photosensitive layer.

The thickness of the charge generating layer is 4 μm or less, preferably, 2 μm or less. It is suitable that the charge transporting layer has a thickness in the range 3–30 μm, preferably 5–20 μm.

Applicable as a binder resin in the practice of this invention are any of the thermoplastic resins and thermosetting resins which are publicly known to be electrically insulating and any of the photocuring resins and photoconductive resins.

Some examples of suitable binders are thermoplastic resins such as saturated polyester, polyamide, acrylic, ethylene-vinyl acetate copolymer, ion cross-linked olefin copolymer (ionomer), styrene-butadiene block copolymer, polycarbonate, vinyl chloride-vinyl acetate copolymer, cellulose ester, polyimide, styrol, etc., and thermosetting resins such as epoxy, urethane, silicone, phenolic, melamine, xylene, alkyd, thermosetting acrylic, etc., and photocuring resins, and photoconductive resins such as poly-N-vinyl carbazole, polyvinyl pyrene, polyvinyl anthracene, polyvinyl pyrrole, etc., all named without any significance of restricting the use to them. Any of these resins can be used singly or in combination with other resins. It is desirable for any of these electrically insulating resins to have a volume resistance of $1\times10^{12}$ Ω·cm or more when measured singly.

Example of charge generating materials useful for the present photosensitive layer are organic substances such as bisazo dyes, triarylmethane dyes, thiazine dyes, oxazine dyes, xanthene dyes, cyanine coloring agents, styryl coloring agents, pyrylium dyes, azo pigments, quinacridone pigments, indigo pigments, perylene pigments, polycyclic quinone pigments, bisbenzimidazole pigments, indanthrone pigments, squalylium pigments, azulene, coloring agents and phthalocyanine pigments; and inorganic substances such as selenium, selenium-tellurium, selenium arsenic, cadmium sulfide, selenium cadmium, zinc oxide and amorphous silicon. Any other material is also usable insofar as it generates charge carriers very efficiently upon absorption of light.

The charge generating materials which can be deposited in vacuum are exemplified by phthalocyanines such as metal phthalocyanine, titanyl phthalocyanine, aluminum chlorophthalocyanine and the like.

Illustrative examples of charge transporting materials for the formation of photosensitive layer are hydrazone compounds, styryl compounds, triphenylmethane compounds, carbazole compounds, enamine compounds, triphenylamine compounds, tetraphenylbenzidine, azine compounds and the like, including carbazole, N-ethylcarbazole, N-vinylcarbazole, N-phenylcarbazole, tethracene, chrysene, pyrene, perylene, 2-phenylnaphthalene, azapyrene, 2,3-benzochrysene, 3,4-benzopyrene, fluorene, 1,2-benzofluorene, 4-(2-fluorenylazo)resorcinol, 2-p-anisolaminofluorene, p-diethylaminoazobenzene, cadion, N,N-dimethyl-p-phenylazoaniline, p-(dimethylamino)stilbene, 9-(4-diethylaminostyryl)anthracene, 2,5-bis(4-diethylaminophenyl)-1,3,5-oxadiazole, 1-phenyl-3-(p-diethylaminostyryl)-5-(p-diethylaminophenyl)-pylazoline, 1-phenyl-3-phenyl-5-pylazolone, 2-(p-diethylaminostyryl)-6-diethylaminobenzothiazole, 2-(p-diethylaminostyryl)-6-diethylaminobenzothiazole, bis(4-diethylamino-2-methylphenyl)phenylmethane, 1,1-bis(4-N,N-diethylamino-2-ethylphenyl)heptane, N,N-diphenylhydrazino-3-methylidene-10-ethylphenoxazine, N,N-diphenylhydrazino-3-methylidene-10-ethylphenothiazine, 1,1,2,2-tetrakis-(4-N,N-diethylamino-2-ethylphenyl)ethane, p-diethylaminobenzaldehyde-N,N-diphenylhydrazone, p-diphenylaminobenzaldehyde-N,N-diphenylhydrazone, N-ethylcarbazole-N-methyl-N-phenylhydrazone, p-diethylaminobenzaldehyde-N-α-naphthyl-N-phenylhydrazone, p-diethylaminobenzaldehyde-3-methylbenzothiazolinone-2-hydrazone, 2-methyl-4-N,N-diphenylamino-β-phenylstilbene, α-phenyl-4-N,N-diphenylaminostilbene, 1,1-bis-(p-diethylaminophenyl)-4,4-diphenyl-1,3-butadiene and the like. Any of these resins can be used singly or in combination with other resins.

A photosensitive member of the present invention permits, in combination with the binder, the use of a plasticizer, such as halogenated paraffin, polybiphenyl chloride, dimethyl naphthalene, dibutyl phthalate or O-terphenyl, the use of an electron-attractive sensitizer, such as chloranil, tetracyanoethylene, 2,4,7-trinitrofluorenone, 5,6-dicyanobenzoquinone, tetracyanoquinodimethane, tetrachlorophthalic anhydride, or 3,5-dinitrobenzoic acid, and the use of a sensitizer, such as methyl violet, rhodamine B, cyanine dye, pyrylium salt, and thiapyrylium salt.

Antioxidant, ultraviolet-absorbing agent, dispersing assistant, anti-settling agent and the like may be used if necessary.

An electrically conductive substrate used for the formation of a photosensitive member of the present invention is exemplified by a sheet or a drum made of metal or alloy such as copper, aluminum, silver, iron, and nickel; a substrate such as a plastic film on which the foregoing metal or alloy is adhered by a vacuum-deposition method or an electroless plating method and the like; a substrate such as a plastic film and paper on which an electroconductive layer is formed by applying or depositing electroconductive polymer, indium oxide, tin oxide etc.

A photosensitive member thus formed may have an adhesion layer or a barrier layer between a substrate and a photosensitive layer, and a surface protective layer.

When an intermediate layer is formed, examples of suitable materials are polymers themselves such as polyimide, polyamide, nitrocellulose, polyvinyl butyral, polyvinyl alcohol, dispersions of materials of low electrical resistance such as tin oxide, indium oxide and the like, or depositions such as aluminum oxide, zinc oxide, silicon oxide and the like. It is preferable that the thickness of the layer is 1 μm or less.

A surface protective layer may be formed with polymer itself such as acrylic resin, polyaryl resin, polycarbonate resin and urethane resin, or formed by dispersing a material with low electroconductive material such as tin oxide, indium oxide. Organic plasma polymerized layer can be also applied and it may contain oxygen, nitrogen, halogen, atoms of Group III or V in the periodic Table if necessary. The thickness of the surface protective layer is desirably 5 μm or less.

A photosensitive member of the present invention can be also applied to a laser printer.

EXAMPLE 1

The bisazo compound represented by the chemical formula [A] below

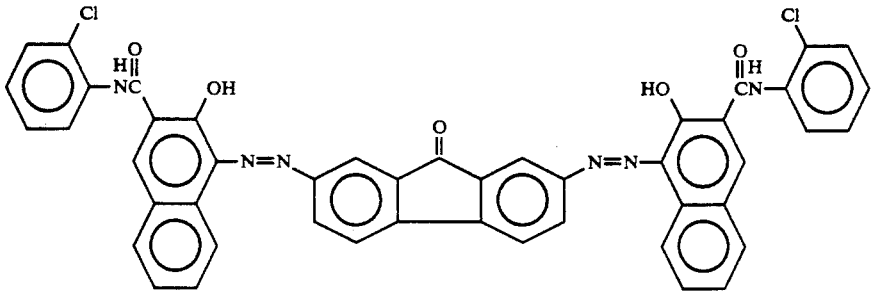

[A]

of one part by weight (referred to as "part" hereinafter), 1 part of polyester resin (Vylon 200 made by TOYOBO K.K.) and 90 parts of cyclohexanone were taken in Sand grinder for dispersion. The dispersion of the bisazo compound was applied onto an aluminum drum to form a charge generating layer so that a thickness of the dried layer would be 0.2 g/m$^2$.

A solution of 10 parts of butadiene compound represented by the chemical formula [B] below;

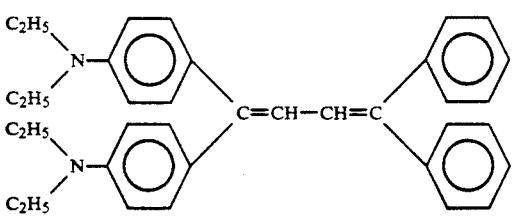

[B]

10 parts of polycarbonate (Panlite K-1300; made by Teijin Kasei K.K.) and 0.5 parts of coumarin compound [I-1] dissolved in 80 parts of tetrahydrofuran was applied onto the above formed charge generating layer to form a charge transporting layer so that the thickness of the dried layer would be about 20 μm. Thus, a photosensitive member with two layers was prepared.

EXAMPLES 2–4

Photosensitive members were prepared in a manner similar to Example 1 except that 0.25 parts, 0.75 parts and 1 part of coumarin compound [I-1] were used.

COMPARATIVE EXAMPLE 1

A photosensitive member was prepared in a manner similar to Example 1 except that coumarin compound [I-1] was not used.

COMPARATIVE EXAMPLE 2

A photosensitive member was prepared in a manner similar to Example 1 except that 2,5-di-ter-butyl-p-cresol of 0.5 parts was added instead of compound [I-1].

COMPARATIVE EXAMPLE 3

A photosensitive member was prepared in a manner similar to Example 1 except that tri-nonylphenylphenyl phosphite was used instead of the compound [I-1].

COMPARATIVE EXAMPLE 4

A photosensitive member was prepared in a manner similar to Example 1 except that phenazine was used instead of the compound [I-1].

COMPARATIVE EXAMPLE 5

A photosensitive member was prepared in a manner similar to Example 1 except that 2-(2'-hydroxy-5'-methylphenyl) benzotriazole of 0.5 parts was added instead of the compound [I-1].

EXAMPLE 5

The bisazo compound represented by the chemical formula [C] below;

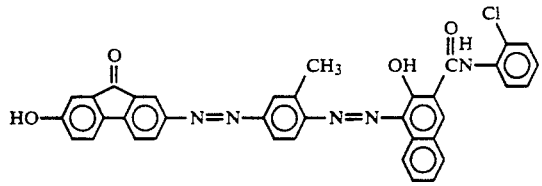

[C]

of 1 part, butyral resin (BH-3; made by Sekisui Kagaku K.K.) of 1 part and cyclohexanone of 90 parts were taken in Sand mill for dispersion. The obtained dispersion of the bisazo compound was applied onto a aluminum drum to form a charge generating layer so that the thickness of the dried layer would be 0.2 g/m$^2$.

A solution of 10 parts of distyryl compound represented by the chemical formula [D] below;

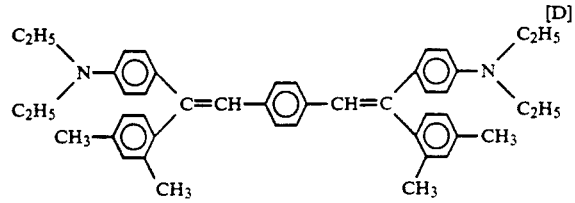

[D]

10 parts of polycarbonate (PC-Z, made by Mitsubishi Kasei K.K.) and 0.3 parts of coumarin compound [I-6]

dissolved in 80 parts of tetrahydrofuran was applied by a dipping method onto the above formed charge generating layer to form a charge transporting layer so that the thickness of the dried layer would be about 20 μm. Thus, a photosensitive member with two layers was prepared.

COMPARATIVE EXAMPLE 6

A photosensitive member was prepared in a manner similar to Example 5 except that the compound [I-6] was not used.

COMPARATIVE EXAMPLE 7

A photosensitive member was prepared in a manner similar to Example 5 except that surfactant of polyoxyethylene nonyl phenyl ether of 0.3 parts was used instead of the compound [I-6].

EXAMPLE 6

Titanyl phthalocyanine of α-type of 4.5 parts, butyral resin (BX-1; made by Sekisui Kagaku K.K.) of 4.5 parts, coumarin compound [I-10] of 0.45 parts by weight and dichloroethane of 500 parts were taken in Sand mill for dispersion. The obtained dispersion was applied onto an aluminum drum to form a charge generating layer so that the thickness of the dried layer would be 0.2 g/m$^2$.

A solution of 10 parts of butadiene compound represented by the chemical formula [B] above mentioned, 40 parts of hydrazone compound represented by the chemical formula [E];

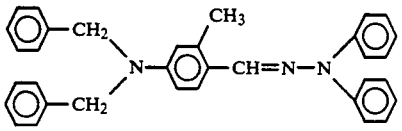

[E]

and 40 parts of polyarylate (U-100; made by Yunichika K.K.) dissolved in 500 parts of tetrahydrofuran was applied onto the above formed charge generating layer to form a charge transporting layer so that the thickness of the dried layer would be about 15 μm. Thus, a photosensitive member with two layer was prepared.

EXAMPLES 7-10

Photosensitive members were prepared in a manner similar to Example 6 except that 0.23 parts, 0.68 parts, 0.9 parts, and 1.35 parts of coumarin compound [I-10] were used.

COMPARATIVE EXAMPLE 8

A photosensitive member was prepared in a manner similar to Example 6 except that the compound [I-10] was not used.

COMPARATIVE EXAMPLE 9

A photosensitive member was prepared in a manner similar to Example 6 except that trinitrofluorenone of 0.45 parts was used instead of the compound [I-10].

COMPARATIVE EXAMPLE 10

A photosensitive member was prepared in a manner similar to Example 6 except that 1H-1,2,4-triazole of 0.45 parts was used instead of the compound [I-10].

EXAMPLE 11

A photosensitive member was prepared in a manner similar to Example 1 except that pyrazoline compound [II-3] was used instead of coumarin [I-1].

EXAMPLE 12-14

A photosensitive members were prepared in a manner similar to Example 11 except that 0.25 parts, 0.75 parts and 1 part of pyrazoline compound [II-3] were used.

EXAMPLE 15

A photosensitive members was prepared in a manner similar to Example 5 except that pyrazoline compound [II-8] was used instead of coumarin compound [I-6.

EXAMPLE 16

A photosensitive member was prepared in a manner similar to Example 6 except that pyrazoline compound [II-10] was used instead of coumarin compound [I-10].

EXAMPLES 17-20

Photosensitive members were prepared in a manner similar to Example 16 except that 0.23 parts, 0.68 parts, 0.9 parts and 1.35 parts of pyrazoline compound [II-10] were used.

EXAMPLE 21

A photosensitive member was prepared in a manner similar to Example 1 except that oxadiazole compound [III-2] was used instead of coumarin [I-1].

EXAMPLES 22-24

A photosensitive members were prepared in a manner similar to Example 21 except that 0.25 parts, 0.75 parts and 1 part of oxadiazole compound [III-2] were used.

EXAMPLE 25

A photosensitive members was prepared in a manner similar to Example 5 except that oxadiazole compound [III-3] was used instead of coumarin compound [I-6].

EXAMPLE 26

A photosensitive member was prepared in a manner similar to Example 6 except that oxazole compound [IV-2] was used instead of coumarin compound [I-10]

EXAMPLES 27-30

Photosensitive members were prepared in a manner similar to Example 26 except that 0.23 parts, 0.68 parts, 0.9 parts and 1.35 parts of oxazole compound [IV-2] were used.

EXAMPLE 31

A photosensitive member was prepared in a manner similar to Example 1 except that stilbene compound [V-5] was used instead of coumarin [I-1].

EXAMPLES 32-34

A photosensitive members were prepared in a manner similar to Example 31 except that 0.25 parts, 0.75 parts and 1 part of stilbene compound [V-5] were used.

EXAMPLE 35

A photosensitive members was prepared in a manner similar to Example 5 except that stilbene compound [V-9] was used instead of coumarin compound [I-6].

EXAMPLE 36

A photosensitive member was prepared in a manner similar to Example 6 except that stilbene compound [V-21] was used instead of coumarin compound [I-10].

EXAMPLES 37–40

Photosensitive members were prepared in a manner similar to Example 36 except that 0.23 parts, 0.68 parts, 0.9 parts and 1.35 parts of stilbene compound [V-21] were used.

EXAMPLE 41

Copper-phthalocyanine (50 parts) and 0.2 parts of tetranitro-copper-phthalocyanine were dissolved in 98% conc. sulfuric acid of 500 parts while stirring. The obtained solution was poured into water of 5000 parts and photoconductive composition of copper-phthalocyanine and tetra-nitro-copper phthalocyanine were deposited. After deposition, the deposits were filtered, washed and dried at 120° C. in a vacuum.

Thus obtained photoconductive composition (10 parts), 22.5 parts of thermosetting acrylic resin (Acrydick A 405; made by Dainippon Ink K.K.), 7.5 parts of melamine resin (Super Beckamine J820; made by Dainippon ink K.K.), pyrazoline compound [F] represented by the chemical formula below;

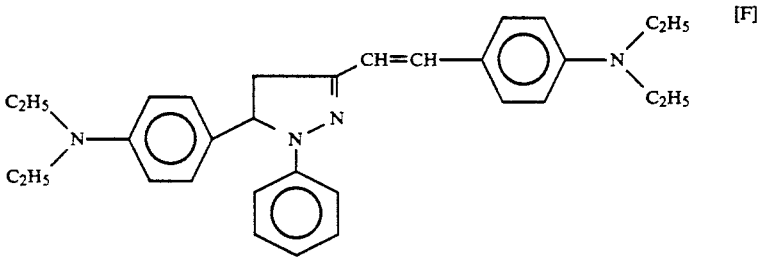

[F]

of 15 parts and stilbene compound [V-23] of 0.6 parts were placed in a ball mill together with a mixed solution of methyl ethyl ketone with xylene at the same amount to be mixed and dispersed for 48 hours. The obtained photosensitive solution was applied onto an aluminum drum and dried so that a photosensitive layer of about 15 μm thickness might be obtained. Thus, a photosensitive member was obtained.

EXAMPLES 42–44

Photosensitive members were prepared in a manner similar to Example 41 except that the compounds [V-28], [VI-3] and [V-30] were used instead of the compound [V-23].

EVALUATION

The photosensitive members thus obtained were installed in a copying machine (EP-50(50ϕ); made by Minolta Camera K.K.) to be corona-charged to the level of −6 KV (+6 KV for the photosensitive members obtained in Examples 41–44). Initial surface potential ($V_0$), exposure values for $V_0$ to reduce to the half level of $V_0$ ($E_{\frac{1}{2}}$) (lux.sec), decreasing rate of $V_0$ ($DDR_1$) which means the $V_0$ decreasing ratio when left for 1 second in the dark. The results are shown in Table 1.

In addition, the photosensitive members were set in the tester for a photosensitive member having similar constitutions to the copying machine as shown in FIG. 1. Photographic properties were measured.

The photosensitive members obtained in Examples and Comparative Examples were installed in a drum for photosensitive member (1), charged by a charger (2) to the level of −500 V (+500 V for the photosensitive member obtained in Examples 41–44). Initial surface potential ($V_0$), surface potential (Vi) and residual potential (Vr) were measured in the order. The potential $V_0$ was measured after 0.3 seconds from the initial charging process. The potential (Vi) is measured after the photosensitive member was exposed by white light (3) emitted from halogen lamp. Then, the residual potential (Vr) was measured after electrical charges were erased by a light eraser (5). The individual potential was measured by a probe (4). After the above process were repeated 5000 times, $V_0$, Vi and Vr were also measured to evaluate repetition properties.

The results were shown in Table 2.

TABLE 1

| | $V_0$ (V) | $E_{\frac{1}{2}}$ (lux · sec) | $DDR_1$ (%) |
|---|---|---|---|
| Example 1 | −660 | 0.9 | 2.6 |
| Example 2 | −650 | 0.9 | 2.8 |
| Example 3 | −660 | 0.9 | 2.5 |
| Example 4 | −670 | 1.0 | 2.3 |
| Example 5 | −660 | 0.7 | 3.0 |
| Example 6 | −670 | 0.8 | 2.4 |
| Example 7 | −660 | 0.8 | 3.0 |
| Example 8 | −670 | 0.8 | 2.3 |
| Example 9 | −670 | 0.9 | 2.0 |
| Example 10 | −680 | 1.0 | 1.8 |
| Com. Ex 1 | −650 | 0.9 | 2.9 |
| Com. Ex 2 | −670 | 1.0 | 2.4 |
| Com. Ex 3 | −630 | 0.9 | 3.5 |
| Com. Ex 4 | −660 | 1.3 | 2.0 |
| Com. Ex 5 | −680 | 2.6 | 1.9 |
| Com. Ex 6 | −660 | 0.7 | 3.3 |
| Com. Ex 7 | −670 | 1.0 | 2.7 |
| Com. Ex 8 | −650 | 0.8 | 3.0 |
| Com. Ex 9 | −420 | 0.7 | 10.5 |
| Com. Ex 10 | −680 | 1.0 | 2.1 |
| Example 11 | −660 | 0.9 | 2.5 |
| Example 12 | −660 | 0.9 | 2.6 |
| Example 13 | −660 | 0.9 | 2.5 |
| Example 14 | −670 | 1.0 | 2.3 |
| Example 15 | −660 | 0.8 | 2.9 |
| Example 16 | −670 | 0.8 | 2.5 |
| Example 17 | −660 | 0.8 | 2.7 |
| Example 18 | −660 | 0.8 | 2.4 |
| Example 19 | −670 | 0.9 | 2.2 |
| Example 20 | −680 | 1.0 | 2.0 |
| Example 21 | −660 | 0.9 | 2.5 |
| Example 22 | −650 | 0.9 | 2.9 |
| Example 23 | −660 | 0.9 | 2.4 |
| Example 24 | −670 | 1.0 | 2.1 |
| Example 25 | −660 | 0.7 | 2.6 |
| Example 26 | −670 | 0.8 | 2.3 |

TABLE 1-continued

| | $V_0$ (V) | $E_{\frac{1}{2}}$ (lux · sec) | $DDR_1$ (%) |
|---|---|---|---|
| Example 27 | −660 | 0.8 | 2.5 |
| Example 28 | −670 | 0.8 | 2.1 |
| Example 29 | −670 | 0.9 | 2.3 |
| Example 30 | −680 | 1.0 | 2.0 |
| Example 31 | −660 | 0.9 | 2.4 |
| Example 32 | −650 | 0.9 | 2.8 |
| Example 33 | −660 | 0.9 | 2.3 |
| Example 34 | −670 | 1.0 | 2.0 |
| Example 35 | −660 | 0.7 | 2.5 |
| Example 36 | −670 | 0.8 | 2.3 |
| Example 37 | −660 | 0.8 | 2.5 |
| Example 38 | −670 | 0.8 | 2.1 |
| Example 39 | −670 | 0.9 | 2.2 |
| Example 40 | −680 | 1.0 | 1.9 |
| Example 41 | +630 | 1.2 | 12.0 |
| Example 42 | +620 | 1.1 | 13.5 |
| Example 43 | +630 | 1.3 | 12.3 |
| Example 44 | +630 | 1.2 | 11.8 |

TABLE 2

| | initial | | | after 5000 times | | |
|---|---|---|---|---|---|---|
| Example/ Com. Ex | $V_0$ (V) | Vi (V) | Vr (V) | $V_0'$ (V) | Vi' (V) | Vr' (V) |
| Example 1 | −510 | −80 | −5 | −500 | −75 | −5 |
| Example 2 | −510 | −75 | −5 | −490 | −65 | −5 |
| Example 3 | −510 | −80 | −5 | −500 | −80 | −5 |
| Example 4 | −515 | −85 | −5 | −510 | −85 | −7 |
| Com. Ex 1 | −500 | −80 | −5 | −380 | −55 | 0 |
| Com. Ex 2 | −510 | −85 | −5 | −420 | −60 | −3 |
| Com. Ex 3 | −500 | −80 | −5 | −330 | −40 | 0 |
| Com. Ex 4 | −510 | −95 | −10 | −480 | −130 | −20 |
| Com. Ex 5 | −510 | −130 | −15 | −450 | −70 | −3 |
| Example 5 | −500 | −70 | 0 | −490 | −70 | −5 |
| Com. Ex 6 | −500 | −70 | −5 | −360 | −40 | 0 |
| Com. Ex 7 | −510 | −85 | −10 | −410 | −95 | −10 |
| Example 6 | −510 | −75 | −5 | −480 | −75 | −5 |
| Example 7 | −500 | −70 | −5 | −460 | −60 | −5 |
| Example 8 | −510 | −75 | −5 | −490 | −75 | −5 |
| Example 9 | −510 | −80 | −10 | −500 | −85 | −10 |
| Example 10 | −510 | −80 | −10 | −505 | −90 | −15 |
| Com. Ex 8 | −500 | −75 | −5 | −320 | −40 | 0 |
| Com. Ex 9 | −370 | −50 | 0 | −130 | −10 | 0 |
| Com. Ex 10 | −510 | −85 | −10 | −430 | −60 | −15 |
| Example 11 | −510 | −80 | −5 | −500 | −75 | −5 |
| Example 12 | −510 | −75 | −5 | −490 | −65 | −5 |
| Example 13 | −510 | −80 | −5 | −500 | −80 | −5 |
| Example 14 | −510 | −85 | −5 | −505 | −80 | −5 |
| Example 15 | −505 | −70 | −5 | −495 | −70 | −5 |
| Example 16 | −510 | −75 | −5 | −480 | −75 | −5 |
| Example 17 | −500 | −70 | −5 | −460 | −60 | −5 |
| Example 18 | −510 | −75 | −5 | −490 | −75 | −5 |
| Example 19 | −510 | −80 | −10 | −500 | −85 | −5 |
| Example 20 | −510 | −80 | −10 | −505 | −90 | −10 |
| Example 21 | −505 | −80 | −5 | −495 | −75 | −5 |
| Example 22 | −500 | −75 | −5 | −490 | −65 | −5 |
| Example 23 | −505 | −80 | −5 | −495 | −80 | −5 |
| Example 24 | −510 | −85 | −5 | −505 | −80 | −5 |
| Example 25 | −505 | −70 | −5 | −495 | −70 | −5 |
| Example 26 | −505 | −75 | −5 | −480 | −75 | −5 |
| Example 27 | −500 | −70 | −5 | −460 | −65 | −5 |
| Example 28 | −505 | −75 | −5 | −490 | −75 | −5 |
| Example 29 | −510 | −80 | −10 | −500 | −85 | −5 |
| Example 30 | −510 | −85 | −10 | −500 | −90 | −10 |
| Example 31 | −505 | −80 | −5 | −500 | −75 | −5 |
| Example 32 | −500 | −75 | −5 | −495 | −65 | −5 |
| Example 33 | −505 | −80 | −5 | −500 | −80 | −5 |
| Example 34 | −510 | −85 | −5 | −505 | −80 | −5 |
| Example 35 | −505 | −70 | −5 | −495 | −70 | −5 |
| Example 36 | −505 | −75 | −5 | −480 | −75 | −5 |
| Example 37 | −500 | −70 | −5 | −470 | −65 | −5 |
| Example 38 | −505 | −75 | −5 | −490 | −75 | −5 |
| Example 39 | −510 | −80 | −10 | −500 | −80 | −5 |
| Example 40 | −510 | −85 | −10 | −505 | −85 | −7 |
| Example 41 | +500 | +100 | +10 | +495 | +100 | +10 |
| Example 42 | +505 | +10 | +10 | +500 | +115 | +10 |
| Example 43 | +500 | +105 | +10 | +500 | +105 | +10 |

TABLE 2-continued

| | initial | | | after 5000 times | | |
|---|---|---|---|---|---|---|
| Example/ Com. Ex | $V_0$ (V) | Vi (V) | Vr (V) | $V_0'$ (V) | Vi' (V) | Vr' (V) |
| Example 44 | +510 | +110 | +10 | +505 | +110 | +10 |

What is claimed is:

1. A photosensitive member comprising a photosensitive layer which comprises a charge generating layer and a charge transporting layer, the charge transporting layer comprising a binder resin, a charge transporting material of 0.01–2 parts by weight on the basis of the binder resin of 1 part by weight, and a coumarin compound of 0.1–40 percent by weight on the basis of the charge transporting material and represented by the formula (I) below:

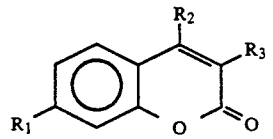

(I)

in which $R_1$ is

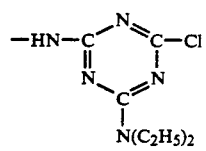

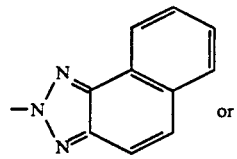

or

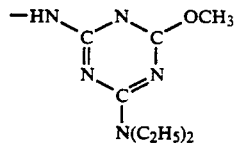

$R_2$ is a hydrogen atom or a fluoroalkyl group; and $R_3$ is a hydrogen atom, an alkyl group or an aryl group.

2. A photosensitive member of claim 1, in which the coumarin is selected from (I-6)

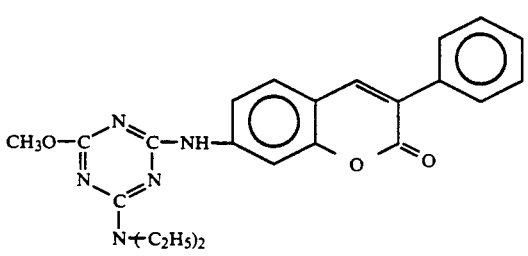

and

-continued (I-10)

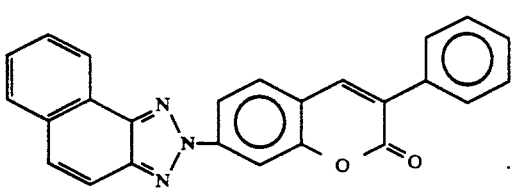

3. A photosensitive member of claim 1, in which the charge transporting layer has a thickness of 3–30 μm and the charge generating layer has a thickness of 4 μm or less.

4. A photosensitive member comprising a photosensitive layer which comprises a charge generating layer and a charge transporting layer, the charge generating layer comprising a binder resin, a charge generating material, and a coumarin compound of 0.01–3 parts by weight on the basis of the charge generating material of 1 part by weight and represented by the formula (I) below:

(I)

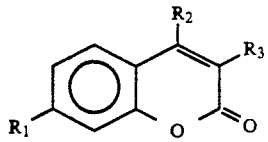

in which $R_1$ is

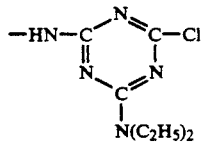

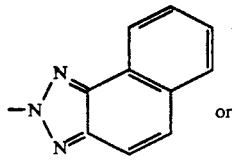

or

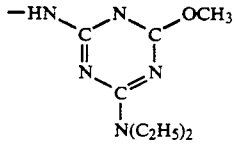

; $R_2$ is a hydrogen atom or a p7 fluoroalkyl group; and $R_3$ is a hydrogen atom, an alkyl group or an aryl group.

5. A photosensitive member of claim 4, in which the charge generating layer has a thickness of 4 μm or less and the charge transporting layer has a thickness of 3–30 μm.

* * * * *